United States Patent [19]

Bengtsson

[11] Patent Number: 4,757,797

[45] Date of Patent: Jul. 19, 1988

[54] APPARATUS IN IGNITION SYSTEMS

[75] Inventor: Jörgen Bengtsson, Krubbenäs, Sweden

[73] Assignee: AB Svenska Elektromagneter, Amal, Sweden

[21] Appl. No.: 30,157

[22] Filed: Mar. 24, 1987

[30] Foreign Application Priority Data

Mar. 27, 1986 [SE] Sweden ..... 8601442

[51] Int. Cl.[4] ..... F02P 3/04

[52] U.S. Cl. ..... 123/602

[58] Field of Search ..... 123/602, 596, 597, 599, 123/600, 605

[56] References Cited

U.S. PATENT DOCUMENTS

| | | | |
|---|---|---|---|
| 4,404,940 | 9/1983 | Sieja | 123/602 |
| 4,436,076 | 5/1984 | Pitco | 123/602 |
| 4,462,363 | 7/1984 | Nanjyo et al. | 123/602 |
| 4,611,569 | 9/1986 | Kondo et al. | 123/602 |
| 4,612,899 | 9/1986 | Honjoh et al. | 123/602 |
| 4,624,234 | 11/1986 | Koketsu et al. | 123/602 |
| 4,644,927 | 2/1987 | Okuda | 123/602 |

*Primary Examiner*—Raymond A. Nelli
*Attorney, Agent, or Firm*—Collard, Roe & Galgano

[57] ABSTRACT

A circuit for generating a charge voltage in a capacitive ignition system having an inductive source for producing a voltage substantially below the required charge voltage. The circuit includes, in series, an electronic switch and a resistor connected across the voltage source to form a controllable current path. Connected parallel thereto is a charging circuit for the capacitive ignition system. A control circuit is connected across the resistor and is adapted to control the state of the electronic switch. The control circuit also has a self-holding circuit. During the build-up of the source voltage, the electronic switch is in its closed state resulting in a heavy current flow therethrough. This in turn results in a build-up of voltage across the resistor actuating the control circuit. The control circuit causes the electronic switch to change into a cutoff state, thereby causing a build-up of the charge voltage for the capacitive ignition system. The self-holding circuit acts to keep the control circuit in a condition for holding the electronic switch in the cutoff state during the presence of the voltage pulse generated by the source.

7 Claims, 2 Drawing Sheets

APPARATUS IN IGNITION SYSTEMS

TECHNICAL FIELD

In connection with flywheel magnetos, e.g. for motorcycles, there is an ever-increasing demand for connecting electronics such as microprocessors and the like for controlling different functions. What it is primarily a question of here is more accurate control of the ignition sequence.

Consequently, flywheel magneto systems are being adapted for generating supply current to electronic apparatus connected thereto as well as conventional lighting current. Spark generating systems are in general use today, which work on the discharge of a capacitor by an ignition transformer, these being known as capacitive ignition systems. Such systems are electrically very simple to handle and have great reliability. Furthermore, triggering capacitor ignition systems can easily be performed with the aid of pulses from a computer.

In capacitive ignition systems it is common to arrange a special generator winding on the flywheel magneto system for generating the necessary charge voltage, which in practice generally goes up to between 300–400 volts. Generally, however, the electronic computer circuits to be connected only require about 9–10 volts, and the lighting which is to be connected often requires even lower voltages. There is thus a problem with regard to achieving sufficient charge voltage for the capacitor system, and the present invention proposes, inter alia, a solution to the problem in question.

THE PRESENT INVENTION

In order to solve the above-mentioned problems with the generation of sufficient charge energy for a capacitive ignition system of the kind in question, it is proposed in accordance with the invention to arrange an electronic closing circuit connected to the low-voltage generator circuit, which keeps it at a high current value during the generation of a voltage pulse in the generator circuit until a predetermined current has been achieved, a self-holding circuit then achieving a non-conductive state in said closing circuit, the transient-like voltage increase occurring by the interruption of the current in the inductive generator causing a charge pulse for the capacitor in the capacitive ignition system.

The present invention will now be explained in detail in connection with an embodiment and with reference to the accompanying drawings.

LIST OF FIGURES

FIG. 1 schematically illustrates a flywheel generator for use in connection with the embodiment in accordance with the invention.

DESCRIPTION OF THE EMBODIMENT

Figure 1:
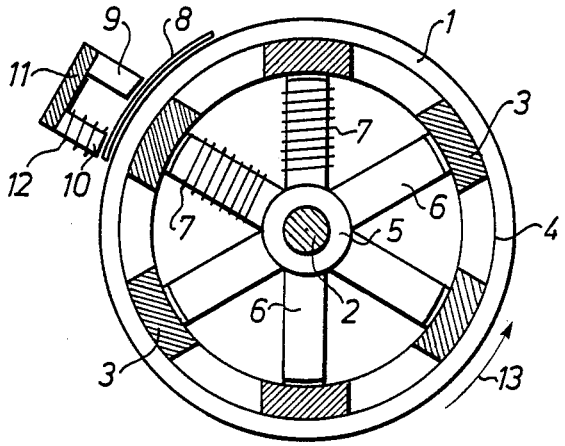

The apparatus illustrated in FIG. 1 comprises a flywheel 1 mounted on a shaft 2 and including six magnets 3 uniformly distributed along the inside of the flywheel. The radially outmost faces of the magnets are magnetically connected to each other by an annular yoke 4 of magnetically conductive material. Centrally about the shaft there is a core 5 of magnetically conductive material from which there project six core legs 6. Each core leg is provided with a generator winding 7, the windings being electrically connected to form a voltage source. Different types of windings can of course be arranged on the core legs, e.g. a winding as the one 7 illustrated for use as a generator winding for electronic apparatus, and a further winding (not shown) intended for lighting. A magnetic tab 8 is mounted on the circumference of the flywheel 1 and has a length equivalent to an arc of about 30°. This tab is arranged to co-act magnetically with a magnetic circuit comprising two legs 9,10 of magnetic material, which are connected to each other by a permanent magnet 11. A winding 12 is mounted on one leg 10. This winding is intended to serve as a trigger winding, i.e. to provide a trigger voltage for the spark function. The flywheel is intended to rotate in the direction illustrated by the arrow 13.

Figure 2:
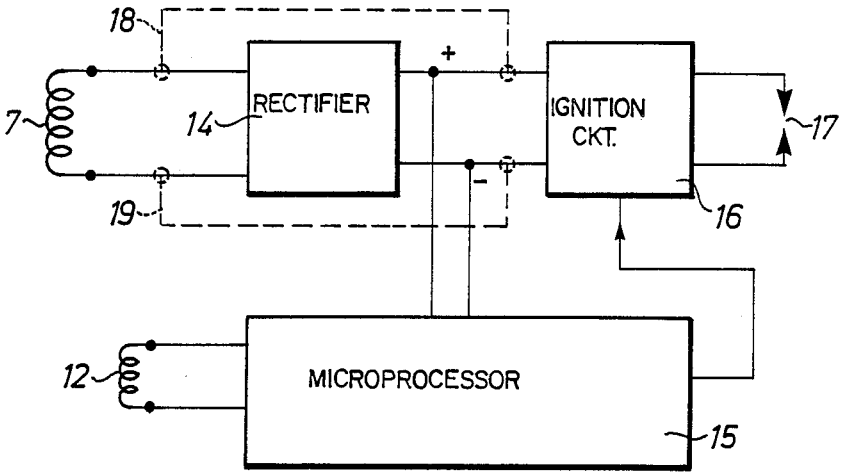
FIG. 2 is a basic circuit for an ignition system coacting with the flywheel magneto according to FIG. 1.

As will be seen from FIG. 2 the windings 7 are here represented by a single winding connected to the input on a rectifier 14. The latter is the voltage source for a microprocessor 15 connected to the system, the trigger winding 12 being connected to the input of the processor, which has its output controlling triggering in a capacitive ignition circuit 16 connected to the system. Connections to a spark plug 17 depart from the capacitive ignition circuit. As indicated by dashed lines 18, the generator windings 7 can be connected directly to the capacitive ignition circuit 16. When the flywheel 1 rotates, a voltage is generated in the windings 7 which accordingly energizes the microprocessor 15. Each time the tab 8 passes the magnetic circuit 9,10,11 a voltage is induced in the trigger winding 12 which is received by the microprocessor 15 and processed in it for generating a command controlling triggering of the capacitive ignition circuit 16. As will be seen, only the relatively low voltage generated in the generator windings 17 intended for operation of the electronics is supplied to the capacitive ignition circuit 16 as input voltage. However, this circuit is designed in a manner apparent from FIG. 3, such that sufficient voltage levels can be extracted from the low-voltage sequences to provide charge voltage.

Figure 3:
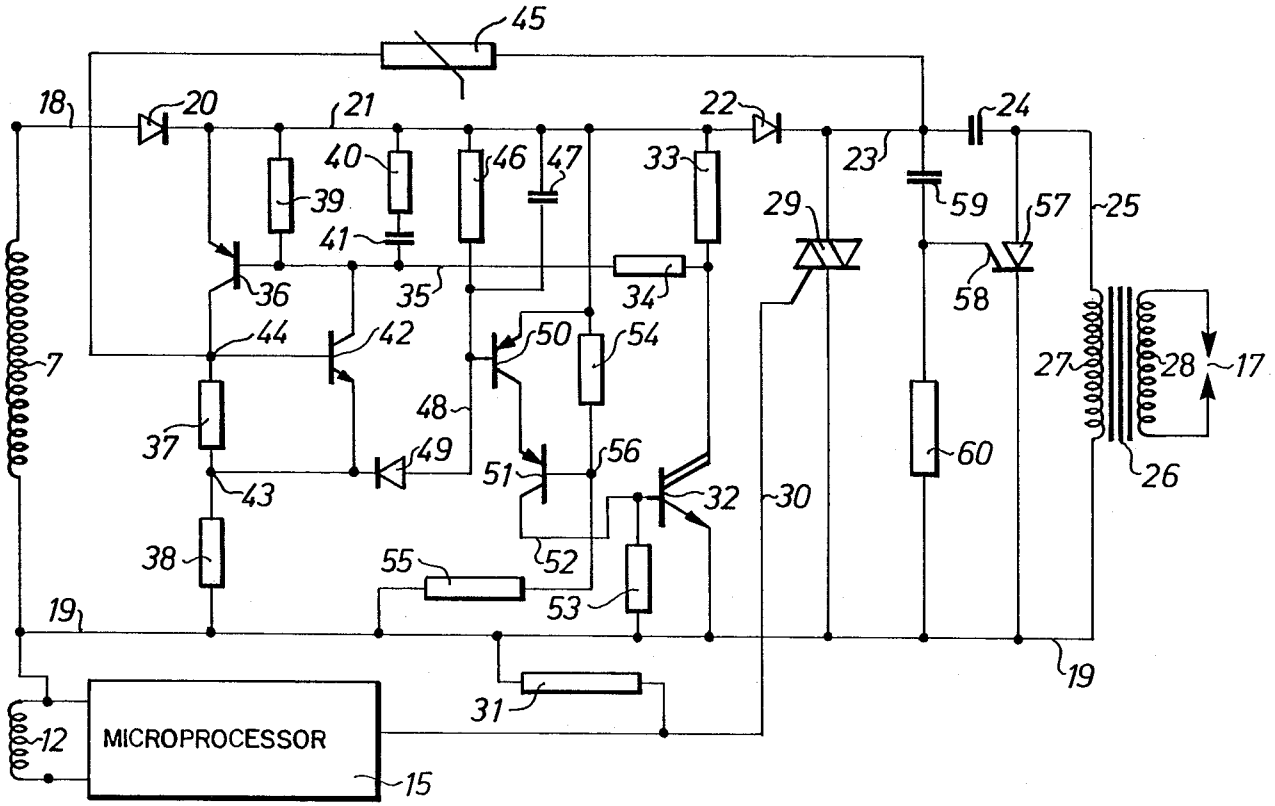
FIG. 3 is a circuit diagram of the embodiment in accordance with the invention.

For the sake of simplifying the explanation, the circuit according to FIG. 3 is assumed to be directly connected to the generator windings 7 via the lines 18,19. One end of the illustrated winding 7 is connected via the line 18 to a rectifier 20, which is in communication via a line 21 with a further similarly poled rectifier 22. A charge capacitor 24 is connected in series with the rectifier 22 by a line 23. The capacitor 24 is connected in series with the primary winding 27 of an ignition transformer 26 via line 25, the other end of the primary winding 27 being in turn connected to the line 19. The secondary winding 28 of the ignition transformer 26 is conventionally connected to the spark plug 17.

To form the conventional discharge path for the capacitor 24, a triac 29 is inserted between the lines 23 and 19, the control electrode 30 of the triac 29 being connected to the control output of the microprocessor 15. A voltage balancing resistor 31 is connected between lines 19 and 30. A Darlington transistor 32 is connected between the lines 21 and 19 via a low-ohmic resistor 33. A resistor 34 is connected between the resistor 33 and the Darlington transistor 32, the resistor 34 being connected in turn to the base of a transistor 36 via a line 35, the emitter-collector current path of the transistor 36 being connected between the lines 21 and 19 via a voltage divider comprising two resistors 37 and 38. A series circuit comprising a resistor 40 and a capacitor 41 is connected in parallel with a resistor 39 between the line 21 and the line 35. A further transistor 42 is coupled between the line 35 and the output 43 between the resistors 37 and 38. The base of the transistor 42 is connected to a point 44 in the connection between the resistor 37 and collector of the transistor 36. From this point 44 there is a connection via a varistor 45 to the line 23. An RC circuit comprising a resistor 46 and a capacitor 47 is connected to a line 48 which, via a diode 49, is connected to the output point 43 between the resistors 37 and 38. The line 48 is connected to the base of a further transistor 50, the emitter-collector path of which is coupled into a series circuit between the lines 21 and 19 via a further transistor 51 with a line 52 and a resistor 53 to the line 19. The line 52 is in direct communication with the base of the Darlington transistor 32. Between lines 21 and 29 there is a voltage divider circuit comprising two resistors 54 and 55, the tap point 56 between these resistors being in communication with the base of the transistor 51.

A further circuit is connected into the system, this circuit comprising a thyristor 57 coupled between the lines 24 and 19. The control electrode 58 of the thyristor is connected to the connection point between a capacitor 59 and a resistor 60 forming a series circuit between the lines 23 and 19.

The illustrated circuit functions in the following manner. It is assumed that a positive voltage half-wave is being built up in the line 18. The Darlington transistor 32 is in a conductive state, resulting in that current begins to flow through the rectifier 20 and line 21 through the resistor 33, Darlington transistor 32 and once again through the line 19. During the sequence now in progress the voltage tends to increase, but due to the conductive state of the Darlington transistor a current shock will be built up in the mentioned current path. A small voltage drop now occurs across the low-ohmic resistor 33, this voltage drop increasing with the current increase and finally forming a sufficient control voltage for the base in the transistor 36. This transistor will then be conductive, whereon current flows through the voltage divider 37,38 and consequently applies control voltage to the base of the transistor 42. Current now flows through the transistor 42 which, via the resistor 39, resistor 37 and transistor 36 forms a self-holding circuit, signifying that the collector of the transistor 42 takes current through the resistor 39 and the transistor 36 thus obtains base voltage, causing current to flow through the resistor 37, to form the base voltage for the transistor 42. The voltage at the point 43 thus increases, signifying that the current path which was previously present through the resistor 46, diode 49 and resistor 38 ceases, current to the base of the transistor 50 also ceasing, thus taking the transistor 50 out of its conductive state. The base current to the transistor 32 thus ceases and the transistor comes into its non-conductive state. This sudden condition results in a considerable voltage increase between the lines 21 and 19, signifying that current will now flow through the rectifier 22 via the line 23 to supply the capacitor 24.

It cannot always be taken for granted that solely by one voltage halfwave on the line 18 there will be a full charge of the capacitor 24, and subsequent voltage halfwaves can contribute to building up the necessary ignition triggering voltage on the capacitor 24. If a plurality of repeated charge pulses come to the capacitor 24, there is a risk that there will be an unintentional spark formation, since the charge goes through the primary winding 27. The thyristor 57 is arranged to avoid this, the RC link comprising capacitor 59 and resistor 40 forming a control circuit for controlling the thyristor 57 so that if there is an overvoltage, the thyristor 57 is caused to come into its conductive state, thus shunting the primary winding 27 and forming a bypass line for it.

In this connection it may happen that too high voltage levels are built up in the capacitor 24, and to prevent this there has been arranged the connection including the varistor 45 between the line 23 and take-off point 44. If voltages should become too high, pulses will be applied to the take-off point 44, signifying a voltage increase across the voltage divider 37,38 such that base current to the transistor 42 is generated, which in turn results in that the self-holding of the transistors 36 and 42 is achieved, resulting in that the Darlington transistor 32 will remain non-conductive. As long as the voltage across the capacitor 24 exceeds the voltage of the varistor 45, current to the base of the transistor 42 is obtained, this transistor then beginning to take current, resulting in that the transistor 36 begins to take current, and as a result thereof the transistor 32 cannot come into its conductive state, as explained above.

In order to keep the transistor chain 36,42,50 and 51 in an operative state in connection with the transient states occurring at the Darlington transistor switchover from conductive to non-conductive state, the previously mentioned RC networks 40,41 and 46,47, respectively, are connected to the associated transistor system circuits.

When the flywheel during its rotation has come to the point where the tab 8 begins to coact with the trigger generating circuit 9–12, a voltage pulse arises, which is received by the microprocessor 15, and is processed in a way not more closely treated here such as to be formed and related in time to control ignition triggering with the aid of the triac 29 and via the line 30.

As will be seen, there is achieved with an apparatus in accordance with the invention an extremely efficient circuit, which may provide the necessary voltages for charging the capacitor in the associated capacitive ignition system. Since the same voltage source can be used for both microprocessor and ignition means, a great deal is won from the point of view of manufacture, since the generator winding side can be formed very simply and robustly, which is particularly necessary with regard to use in motorcycles. It may be mentioned that in practice the generator includes more poles than the six illustrated, e.g. twelve, thus obtaining more flux changes and consequently pulses for each revolution.

I claim:

1. An apparatus for generating a charge voltage in a capacitive ignition system from an inductive voltage source producing a voltage substantially below the required charge voltage, comprising:

an electronic switch and a resistor, connected in series across the inductive voltage source to form a controllable current path;

a charging circuit connected parallel thereto and to the capacitive ignition system; and a control circuit connected across said resistor and adapted to control the state of said electronic switch, said control circuit including a self-holding circuit, said electronic switch being in its closed state during the build-up in voltage from the source, resulting in a heavy current flow therethrough, in turn resulting in a build-up of a voltage across said resistor, and actuating said control circuit which actuates said electronic switch to change into a cutoff state, thereby resulting in the build-up of a charge voltage for the capacitive ignition system, said self-holding circuit being active to keep said control circuit in a condition for holding said electronic switch in said cutoff state during the presence of a voltage pulse generated by the source.

2. An apparatus as claimed in claim 1, wherein said electronic switch comprises a transistor, the base of which is connected to the control circuit which control circuit includes a transistor switch which, when it is subjected to triggering voltage, via said resistor is switched into a self-holding state maintained by return resistors connected to the electronic switch.

3. An apparatus as claimed in claim 2, wherein when said transistor switch is in its self-holding state a condition is provided in a coacting voltage divider circuit that a switch coupled thereto and controlling the base of the transistor switch becomes inactive, resulting in an open state of the transistor switch.

4. An apparatus as claimed in claim 3, wherein said voltage divider circuit is in communication with the base of a first transistor connected in series with a second transistor forming a control current path for the transistor switch.

5. An apparatus as claimed in claim 1, wherein said capacitive ignition system further includes a capacitor circuit in which the charge voltage causes a charge current to flow through a primary winding of a connected ignition transformer, and having a controllable bypass line connected across said primary winding, the controllable bypass line being activated so that a shunt path for the primary winding is formed if the charge pulse has a steepness corresponding to a preset value.

6. An apparatus as claimed in claim 2, wherein the control circuit is connected to a charge capacitor such that the self-holding state can be maintained if the charge voltage exceeds a predetermined value.

7. An apparatus as claimed in claim 6 wherein said connection with the charge capacitor comprises a varistor connected to the current path for the transistor swtich of the control circuit.

* * * * *